United States Patent [19]

Dlugokecki

[11] Patent Number: 4,881,880

[45] Date of Patent: Nov. 21, 1989

[54] DRAIN FOR INTERNAL GEAR HYDRAULIC DEVICE

[75] Inventor: Andrew N. Dlugokecki, Bridgton, Me.

[73] Assignee: Parker Hannifin Corporation, Cleveland, Ohio

[21] Appl. No.: 183,196

[22] Filed: Apr. 19, 1988

[51] Int. Cl.[4] ..... F03C 2/08; F03C 1/113

[52] U.S. Cl. ..... 418/61.3; 418/102

[58] Field of Search ..... 418/61.3, 102

[56] References Cited

U.S. PATENT DOCUMENTS

| | | | |
|---|---|---|---|
| 3,572,983 | 3/1971 | McDermott | 418/61.3 |
| 4,411,607 | 10/1983 | Wustof et al. | 418/61.3 |
| 4,432,710 | 2/1984 | Hansen et al. | 418/61.3 |
| 4,545,748 | 10/1985 | Middlekauff | 418/61.3 |
| 4,586,885 | 5/1986 | Middlekauff | 418/61.3 |
| 4,699,577 | 10/1987 | Dlugokecki et al. | 418/61.3 |
| 4,762,479 | 8/1988 | Uppal | 418/102 X |

*Primary Examiner*—Carlton R. Croyle
*Assistant Examiner*—Leonard P. Walnoha
*Attorney, Agent, or Firm*—Christopher H. Morgan

[57] ABSTRACT

An improved, high-pressure fluid draining, internal gear hydraulic device of the type having a rotatable valve plate which selectively communicates inlet and outlet ports of a commutator with opening and closing fluid chambers between internal and external gear. The valve plate has radially extending drain ports which drain high pressure fluid from the area inside the valve plate to a check valve system outside the valve plate. This check valve system can drain to a low pressure fluid port of the device such as the inlet or outlet of the pump.

2 Claims, 5 Drawing Sheets

DRAIN FOR INTERNAL GEAR HYDRAULIC DEVICE

BACKGROUND OF THE INVENTION

1. Field of the Invention

The present invention relates generally to internal gear hydraulic devices that can be used as pumps or motors and, more particularly, to internal gear hydraulic devices with high pressure fluid adjacent the drive shaft which must be drained.

2. Description of the Prior Art

Many types of prior art hydraulic devices have utilized internal gear sets which are often called gerotors or rotors. Such devices can be used as pumps where shaft work is converted to hydraulic work and as motors where hydraulic work is converted to shaft work. Examples of gerotor pumps and motors are shown in U.S. Pat. Nos. 3,572,983; 4,411,607; 4,545,748; and 4,586,885. In an internal gear pump or motor, an inner gear having outwardly directed teeth cooperates with an external gear having inwardly directed teeth so that fluid chambers therebetween increase and decrease in volume as the inner and outer gears rotate in a housing. By connecting the inlet and outlet of the device to the proper location along the sides of the gear set, the variable displacement chambers receive and discharge hydraulic fluid so that the device can function as a pump or motor. A shaft or other mechanical device can be connected to either the inner or outer gear depending upon the type of device.

Many of the internal gear pumps and motors of the prior art utilize a housing having a fixed inlet and outlet. In other gerotor pumps and motors, a rotary valve plate or disc is used. An example of gear devices with a rotary valve plate are shown in U.S. Pat. Nos. 4,411,607; 4,545,748; 4,586,885; and 4,699,577. As described in these patents, the internal gear devices with rotary valves have a control plate or commutator with a plurality of inlet and outlet openings or windows on an axial face thereof. A valve plate with a plurality of openings extending axially therethrough is disposed between the gear set and the commutator to selectively communicate the inlet and outlet openings with the variable displacement chambers in the gear set. The valve plate is connected to rotate with the gear set such that the closing variable displacement chambers in the gear set are connected with the outlet openings of the commutator while the opening variable displacement chambers of the gear set are connected with the inlet.

One particular problem in the prior art is that high pressure fluid leaks to and must be drained from the area adjacent the drive shaft. Generally, to accomplish this has required drilling a hole through the end of the housing to the space adjacent the shaft, connecting this hole to a port which winds its way around the exterior of the housing to a check valve which allows fluid to pass into a low pressure hydraulic fluid port of the motor or pump. This requires many machining steps.

SUMMARY OF THE INVENTION

It is accordingly an object of the present invention to provide an improved internal gear device with a drain which drains the area adjacent the drive shaft in a more direct, more efficient and less expensive fashion.

In accordance with this object the present invention provides an improved internal gear hydraulic device of the type having a housing with a rotatable valve plate therein which selectively communicates inlet and outlet ports of a commutator with opening and closing fluid chambers between an internal and external gear, the internal gear of which is connected with a drive shaft.

The present invention includes a check valve disposed in the housing adjacent the valve plate. The check valve has an inlet which is in fluid communication with an area adjacent the radially outer edge of the valve plate. It has an outlet which drains to a low pressure hydraulic fluid port (either the inlet or outlet of the pump housing depending upon whether the device is a motor or a pump). The valve plate has a drain port which extends from a radially inner surface of the valve plate to a radially outer surface of the valve plate. The radially inner surface of the valve plate is adjacent and in fluid communication with the area around the shaft which contains high pressure fluid desired to be drained. The radially outer surface of the valve plate is adjacent and in fluid communication with the inlet of the check valve. Thus, the drain port allows high pressure fluid adjacent the drive shaft to be drained directly and efficiently through the valve plate and check valve into a low pressure port of the housing.

For a further understanding of the invention and further objects, features and advantages thereof, reference may now be had to the following description taken in conjunction with the accompanying drawings.

DESCRIPTION OF THE PREFERRED EMBODIMENT

Figure 1:
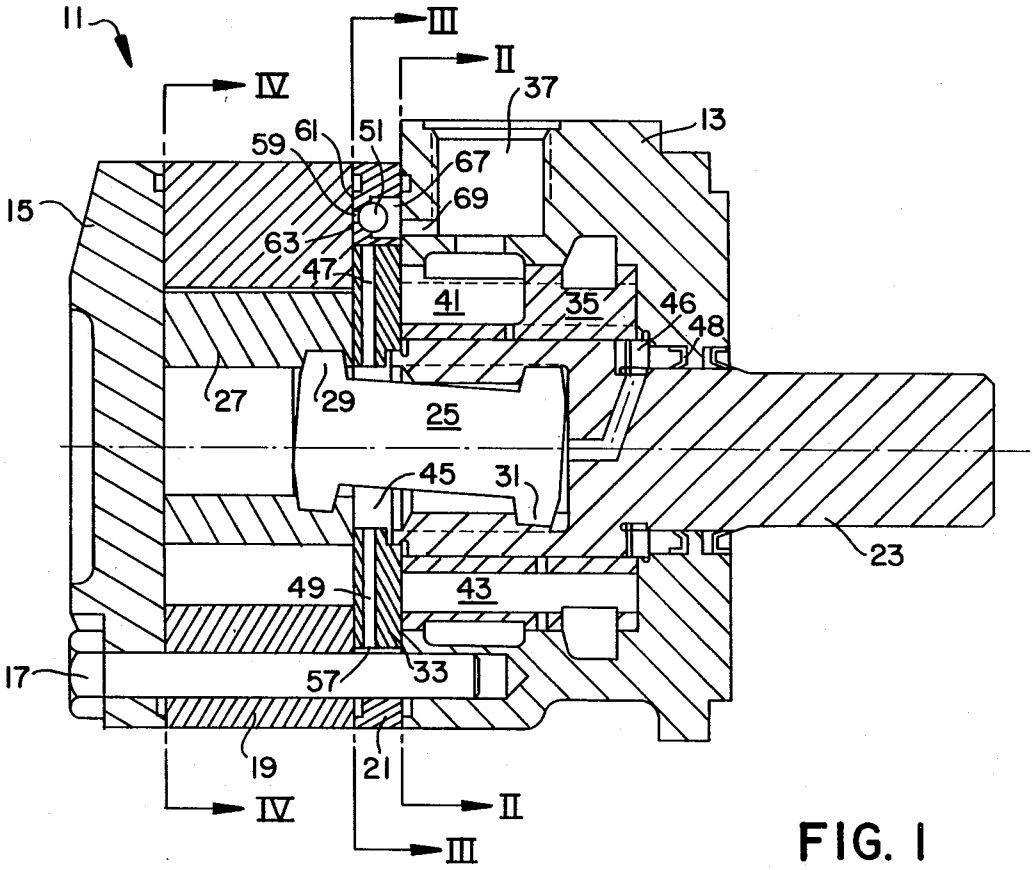
FIG. 1 is a cross sectional view of an improved internal hydraulic gear device constructed in accordance with the present invention.
Figure 2:
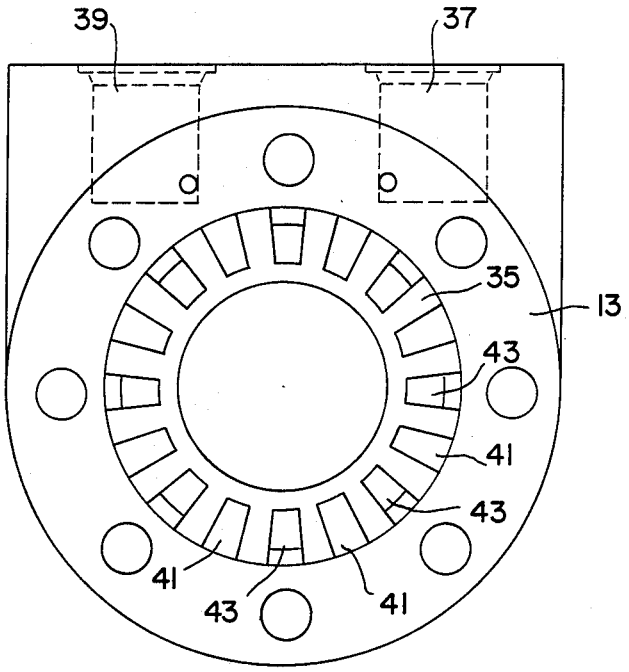
FIG. 2 is a cross sectional view of the device shown in FIG. 1 taken along the lines shown in FIG. 1.

The present invention provides an improved internal gear hydraulic motor or pump of the type shown in U.S. Pat. No. 4,545,748. The operation of the internal gears and other parts of the machine are well known in the art and are described in this patent. The general description of the operation of these parts contained in this patent is not described herein, and for the purpose of understanding these details, the description therein is hereby incorporated by reference.

Referring now to FIGS. 1 through 4, an internal gear hydraulic device constructed in accordance with the present invention is shown at 11. The device includes a front housing piece 13 and a rear housing piece 15 connected by bolts 17. An outer gear 19 and a plate spacer 21 are sandwiched between the rear housing piece 15 and the front housing piece 13 with the bolts 17 extending therethrough. These pieces together form the outside of the device 11.

Extending into the interior of the device 11 through the front housing piece 13 is a shaft 23. The shaft 23 is connected by a wobbling double ended gear shaft 25 to an inner gear 27. The wobbling double ended gear shaft 25 is often referred to as a dog bone gear because it has gear teeth 29 and 31 extending outwardly on opposite ends of this device which cause it to have a dog bone shape. Gear teeth 29 engage mating teeth on the interior of the inner gear 27 and gear teeth 31 engage mating teeth on the interior of shaft 23.

The gear set formed by the outer gear 19 and the inner gear 27 combine so that the inner gear 27 rotates in an orbiting motion inside outer gear 19. The outwardly directed teeth of the inner gear 27 cooperate with the external gear having inwardly directed teeth so that fluid chambers therebetween increase and decrease in volume as the inner gear rotates in an orbiting motion. By connecting the increasing and decreasing fluid chambers to hydraulic inlets and outlets the device can function as a pump or motor.

Connecting the increasing and decreasing fluid chambers of the inner and outer gears 27 and 19 are inlet and outlet ports or conduits which extend through valve plate 33 commutator 35 and front housing piece 13. Since the device is reversible, the inlet and outlet ports reverse their function with the reversal of the rotation of the shaft 23 when operating as either a motor or a pump. Thus, port 37 functions as an inlet during counter clockwise rotation of the shaft 23 and port 39 serves as an inlet in clockwise rotation of the shaft 23. When the port 37 is an inlet the port 39 is an outlet and vice versa. Port 37 is connected to an array of ports 41 in commutator 35 and port 39 is connected to an array of ports 43 in commutator 35. The array of ports 41 alternates with the array of ports 43. These ports selectively join with an array of axial openings in valve plate 33 as valve plate 33 rotates to coordinate the flow of hydraulic fluid into and out of the increasing and decreasing fluid chambers between the inner and outer gears 27 and 19.

During operation of the device, high pressure fluid from between the inner and outer gears 27 and 19 leaks into the cavity or area 45 which surrounds the shafts 23 and 25. This high pressure fluid in the cavity 45, if not relieved or drained, acts on both end housings directly. On the rear cover 15 end of the device this high pressure fluid in cavity 45 causes rear cover deflection which results in increased cross chamber leakage in the rotors and lower volumetric efficiency. On the front housing 13 end of the device the high pressure fluid in cavity 45 exerts an axially outward force on the shaft 23 which in turn bears against the thrust bearing assembly 46 causing an increased rate of wear. In addition, the pressure fluid in cavity 45 also acts on the high pressure lip seal 48 thereby accelerating seal wear and decreasing time to external hydraulic fluid leakage. Accordingly, it is desirable to efficiently drain the fluid in this area to a non-working low pressure portion of the device such as the low pressure ports 37 and 39.

To achieve this operation drain ports 47 and 49 are provided in the valve plate 33, check valves 51 and 53 are provided in plate spacer 21 and a fluid path is provided through the check valves to ports 37 and 39. This allows high pressure fluid to be drained from the cavity 45 through the valve plate 33, the plate spacer 21, the front housing piece 13 and into the low pressure port of either port 37 or 39.

Figure 5:
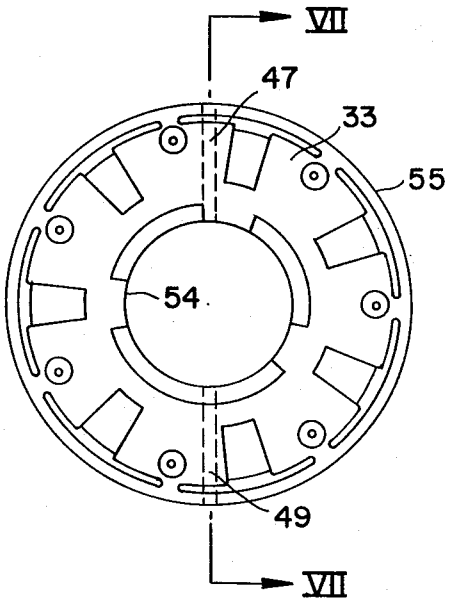
FIG. 5 is a front view of the valve plate shown in FIG. 1.
Figure 7:
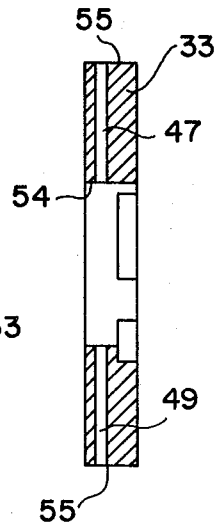
FIG. 7 is a cross sectional view of the valve plate of FIG. 5 taken along the lines shown in FIG. 5.
Figure 6:
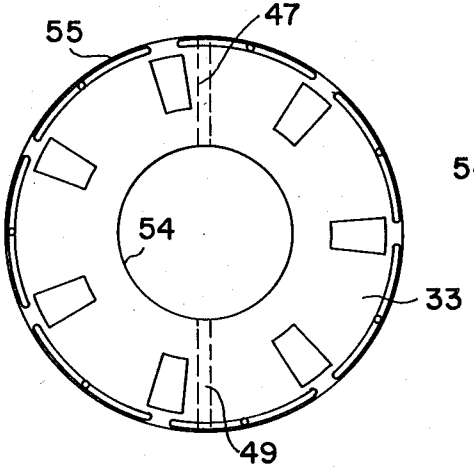
FIG. 6 is a rear view of the valve plate shown in FIG. 5.

Valve plate 33 is shown in more detail in FIGS. 5 through 7. The drain ports 47 and 49 in the valve plate 33 extend radially from a radially inner surface 54 to a radially outer surface 55 of valve plate 33. They are disposed on opposite sides of the valve plate 33 approximately 180 degrees from each other. The radially inner surface 54 is adjacent cavity 45 and is sealed from the high and low pressure working areas of the device 11 by the close fitting edges of the valve plate, commutator, inner and outer gears. The radially outer surface 55 is disposed adjacent a cavity 57 which extends between the valve plate 33 and the plate spacer 21. Thus, the ports 47 and 49 provide a fluid communication between the cavities 45 and 57.

Figure 3:
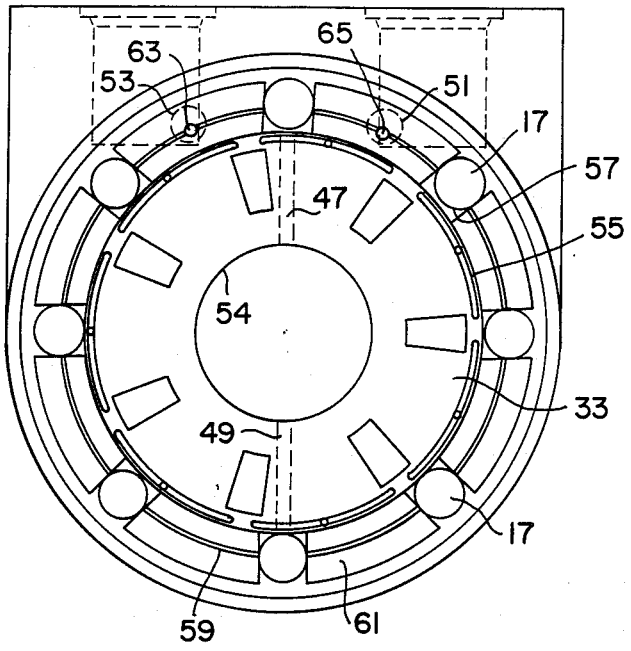
FIG. 3 is a cross sectional view of the device of FIG. 1 taken along the lines shown in FIG. 1.
Figure 4:
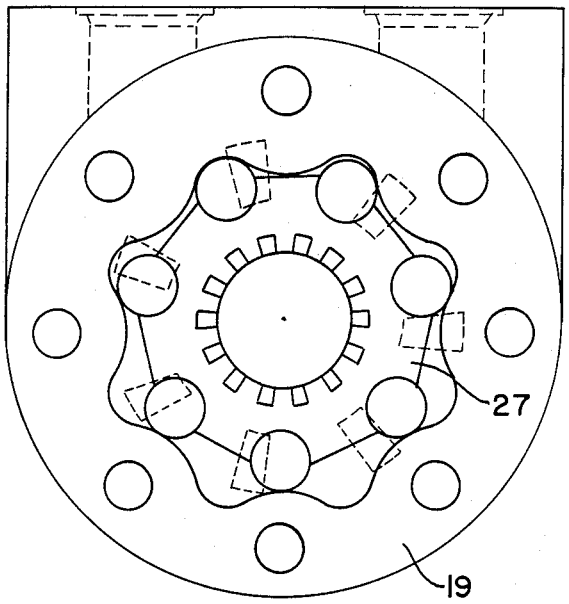
FIG. 4 is a cross sectional view of the device shown in FIG. 1 taken along the lines shown in FIG. 1.

Referring now to FIG. 3 it can be seen that the cavities 57 extend into openings which are provided to receive bolts 17 therethrough. A groove 59 is provided on the face 61 of plate spacer 21. This allows fluid from cavity 57 to pass into the inlet 63 or 65 of check valves 51 and 53 respectively.

The outlets of the check valves 51 and 53 are in fluid communication with the ports 37 and 39, respectively. As shown in FIG. 1, the outlet 67 of check valve 51 is connected by a port 69 in front housing piece 13 to port 37 in piece 13.

Of course, since the ports 37 and 39 can be either high or low pressure depending upon the direction of rotation of the shaft 23 and whether the device is operating as a pump or a motor, it is necessary to allow the high pressure fluid to drain into either of the ports 37 and 39. The check valves 51 and 53 allow this.

During operation the high pressure fluid which enters cavity 45 is drained into the cavity 57 through drain ports 47 and 49. This fluid then drains through grooves 59 into the inlet 63 of either check valve 51 or 53. The selected one of these which is connected to the low pressure one of ports 37 and 39 then allows the fluid to drain into the low pressure one of ports 37 and 39. Obviously the high pressure one of ports 37 and 39 will cause the non-selected check valve of valves 51 and 53 to seal to prevent high pressure fluid from entering the motor through the drain.

Thus, the internal gear hydraulic device with drain as described is well adapted to obtain the objects and advantages mentioned as well as those inherent therein. While presently preferred embodiments of the invention have been described for the purpose of this disclosure, numerous changes in the construction or arrangement of parts can be made by those skilled in the art, which changes are encompassed within the spirit of this invention as defined by the appended claims.

The foregoing disclosure and showings made in the drawings are merely illustrative of the principles of this invention and are not to be interpreted in a limiting sense.

What is claimed is:

1. An improved internal gear hydraulic device of the type having a housing with a rotatable valve plate therein which selectively communicates inlet and outlet ports of a commutator with opening and closing fluid chambers between an internal and external gear, the internal gear of which is connected with a drive shaft; the improvement comprising:

a check valve disposed in said housing and having an inlet adjacent said valve plate and an outlet connected to a drain of said internal gear hydraulic device;

said valve plate having a radially inner surface in fluid communication with an area adjacent said shaft and a radially outer surface in communication with the inlet of said check .valve;

said valve-plate having at least one drain port extending from said radially inner surface to said radially outer surface to allow fluid to be drained from said area adjacent said drive shaft to and through said check valve.

2. The improved internal gear hydraulic device of claim 1 wherein said valve plate has at least two drain ports extending from said radially inner surface to said radially outer surface and disposed approximately 180 degrees from each other on said valve plate.

* * * * *